US008292647B1

(12) United States Patent
McGrath et al.

(10) Patent No.: US 8,292,647 B1
(45) Date of Patent: Oct. 23, 2012

(54) SOCKET CONNECTOR

(75) Inventors: James L. McGrath, Bloomingdale, IL (US); Richard Ma, Kunshan (CN)

(73) Assignees: Tyco Electronics Corporation, Berwyn, PA (US); Tyco Electronics (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 13/158,810

(22) Filed: Jun. 13, 2011

(51) Int. Cl.
*H01R 13/62* (2006.01)

(52) U.S. Cl. ..... 439/327

(58) Field of Classification Search ..... 439/159, 439/160, 327, 329
See application file for complete search history.

(56) References Cited

U.S. PATENT DOCUMENTS 5,434,752 A * 7/1995 Huth et al. ..... 361/798
5,629,836 A * 5/1997 Wright ..... 361/755
5,669,782 A * 9/1997 Yodogawa ..... 439/327
5,997,329 A * 12/1999 Kosmala ..... 439/260
6,461,169 B1 * 10/2002 Harrison et al. ..... 439/65
6,780,018 B1 8/2004 Shipe
6,855,009 B2 * 2/2005 Nishiyama ..... 439/637
7,037,125 B1 * 5/2006 Kuan et al. ..... 439/159
8,147,265 B2 * 4/2012 Chiu ..... 439/328
2005/0208806 A1 * 9/2005 Oila et al. ..... 439/160
2006/0160390 A1 * 7/2006 Miura et al. ..... 439/260
2007/0149018 A1 * 6/2007 Gunther et al. ..... 439/160
2008/0318448 A1 * 12/2008 Ringler et al. ..... 439/78
2012/0045913 A1 * 2/2012 Bodmann et al. ..... 439/153

* cited by examiner

*Primary Examiner* — Briggitte R Hammond

(57) ABSTRACT

A socket connector includes a dielectric housing extending longitudinally between a first end and a second end. The dielectric housing has a slot that extends longitudinally. The slot is configured to receive a circuit card therein. Contacts are held by the dielectric housing and exposed at the slot. The contacts are configured to be electrically connected to the circuit card. The contacts are configured to be terminated to a circuit board. A latch is provided at the first end and is configured to secure the circuit card in the dielectric housing. The latch includes a power conductor. The power conductor is configured to be electrically connected to the circuit card. The power conductor is configured to be terminated to the circuit board to supply power between the circuit board and the circuit card.

20 Claims, 4 Drawing Sheets

SOCKET CONNECTOR

BACKGROUND OF THE INVENTION

The subject matter herein relates generally to socket connectors.

Electronic devices, such as computers, workstations and servers, may use numerous types of electronic modules, such as processor and memory modules (e.g. Dynamic Random Access Memory (DRAM), Synchronous Dynamic Random Access Memory (SDRAM), Double Data Rate (DDR) SDRAM, DDR2 SDRAM, DDR3 SDRAM, DDR4 SDRAM, or Extended Data Out Random Access Memory (EDO RAM), and the like). The memory modules are produced in a number of formats such as, for example, Single In-line Memory Module (SIMM), or Dual In-line Memory Modules (DIMM). Typically, the memory modules have a circuit board that is installed in a multi-pin socket connector mounted on a system board or motherboard. Each memory module has a card edge that provides an interface generally between two rows of contacts in the socket connector. The memory modules include memory devices mounted on the circuit board that store data for the electronic device. The memory devices require power to operate, and the power is supplied to the memory devices by the contacts within the socket connector.

Known electronic devices having memory modules are not without disadvantages. For instance, the power requirement to operate the memory devices has increased over time as the electronic devices are designed to operate more quickly and/or as the amount of data being stored by the memory devices is increased. Additionally, the size of the connectors has decreased and/or the number of contacts has increased, leading to smaller contacts and/or a reduced contact pitch in the connectors. Current designs have limitations in the amount of power that can be supplied to the circuit cards. For example, the current carrying capacity of the contacts within the socket connector limits the amount of current that can be passed across the interface between the socket connector and the system board. Moreover, typical memory modules are designed to particular specifications, which limit potential solutions to supplying enough power to the memory modules. For example, some memory modules have specifications that limit the size or footprint of the modules where the corresponding socket connectors have a particular size and contact arrangement. The physical boundary constraints of the modules limit the number and size of the contacts that may be provided within the socket connector.

A need remains for a socket connector that is capable of supplying more power to circuit cards than current socket connectors.

BRIEF DESCRIPTION OF THE INVENTION

In one embodiment, a socket connector is provided having a dielectric housing extending longitudinally between a first end and a second end. The dielectric housing has a slot that extends longitudinally. The slot is configured to receive a circuit card therein. Contacts are held by the dielectric housing and exposed at the slot. The contacts are configured to be electrically connected to the circuit card. The contacts are configured to be terminated to a circuit board. A latch is provided at the first end and is configured to secure the circuit card in the dielectric housing. The latch includes a power conductor. The power conductor is configured to be electrically connected to the circuit card. The power conductor is configured to be terminated to the circuit board to supply power between the circuit board and the circuit card.

In another embodiment, a socket connector is provided having a dielectric housing extending longitudinally between a first end and a second end. The dielectric housing has a slot extending longitudinally. The slot is configured to receive a circuit card therein. Contacts are held by the dielectric housing and exposed at the slot. The contacts are configured to be electrically connected to the circuit card. The contacts are configured to be terminated to a circuit board. A latch is provided at the first end that is movable between a latched position and an unlatched position. The latch is configured to engage the circuit card in the latched position. The latch holds a power conductor that extends between a first mating interface and a second mating interface. The power conductor is movable with the latch. The first mating interface is mated to the circuit card when the latch is in the latched position. The first mating interface is unmated from the circuit card when the latch is in the unlatched position. The second mating interface is configured to be terminated to the circuit board to supply power between the circuit board and the circuit card.

In a further embodiment, a socket connector system is provided having a circuit card having a circuit board extending between a first edge and a second edge. The circuit board has a card edge that extends between the first and second edges of the circuit board. The circuit board has card contacts at the card edge. The memory card circuit board has an edge power contact at the first edge. The circuit card has at least one memory component terminated to the circuit board that is electrically connected to the edge power contact and at least one of the card contacts. The socket connector system includes a socket connector having a dielectric housing that extends longitudinally between a first end and a second end. The dielectric housing has a slot extending longitudinally. The slot receives the card edge of the circuit board therein. Contacts are held by the dielectric housing and exposed at the slot. The contacts are electrically connected to corresponding card contacts. The contacts are configured to be terminated to a circuit board. A latch is provided at the first end that engages the first edge to secure the circuit card in the dielectric housing. The latch holds a power conductor with the power conductor being configured to be electrically connected to the edge power contact. The power conductor is configured to be terminated to the circuit board to supply power between the circuit board and the circuit card.

DETAILED DESCRIPTION OF THE INVENTION

Figure 1:
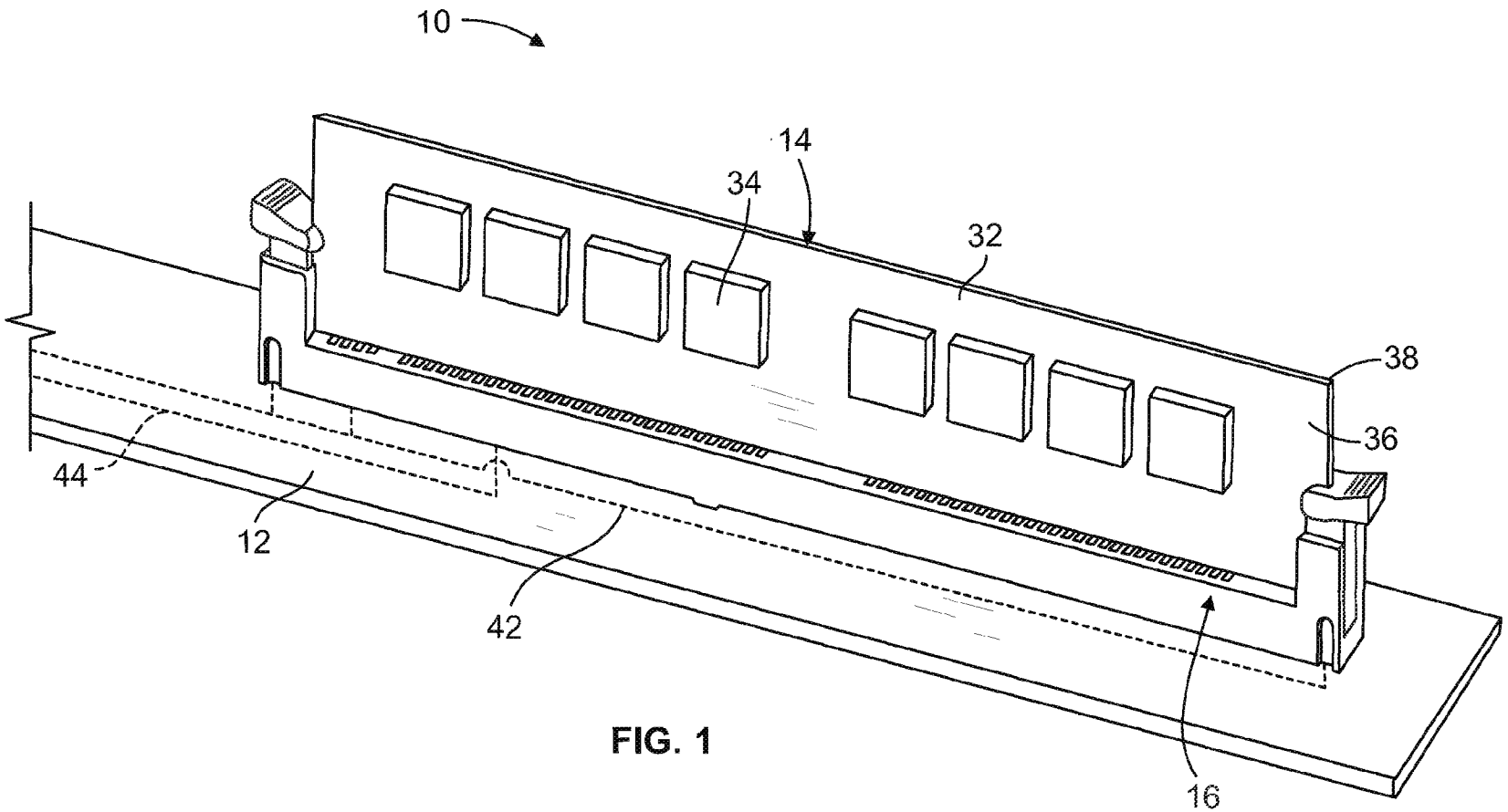
FIG. 1 is a perspective view of a socket connector system formed in accordance with an exemplary embodiment.

FIG. 1 is a perspective view of a socket connector system 10 formed in accordance with an exemplary embodiment.

The socket connector system 10 may be part of a memory system that stores data for an electronic device, such as, for example, a computer, a workstation, a server, and the like. The electronic device may include one or more electronic modules, such as a processor, that is connected with the memory system. The electronic device may include a circuit board 12, such as a motherboard or system board. The electronic device may also include one or more power sources that are connected with the memory system via the circuit board 12. For example, the power source may be electrically connected to traces of the circuit board 12, which supply power to the socket connector system 10.

In an exemplary embodiment, the memory system includes a circuit card 14 connected to the circuit board 12 by a socket connector 16. The circuit card 14 may be a daughter card and the circuit board 12 may be a motherboard. The circuit card 14 may constitute a Synchronous Dynamic Random Access Memory (SDRAM) module. Optionally, the circuit card 14 may be a Dual In-line Memory Module (DIMM module). Any number of circuit cards 14 may be provided within the memory system. Additionally, any number of memory systems may be provided within the electronic device. In alternative embodiments, the socket connector 16 and circuit card 14 may not be part of a memory system, but rather may have other types of components on the circuit card 14.

In an exemplary embodiment, the socket connector 16 and the circuit card 14 are electrically connected to one or more data devices, such as the electronic modules, for sending data thereto and/or receiving data therefrom. The circuit card 14 stores data generated by the data devices and/or sends stored data to the data devices. The socket connector 16 and the circuit card 14 are connected to the data devices via the circuit board 12.

The circuit card 14 includes a circuit board 32 and a plurality of memory devices 34 coupled to the circuit board 32. The memory devices 34 may be integrated circuit (IC) chips or other electronic components for storing data. Any number of memory devices 34 may be electrically connected to the circuit board 32. In the illustrated embodiment, eight memory devices are mounted to a first side 36 of the circuit board 32. Memory devices 34 may also be mounted to a second side 38 of the circuit board 32. In an alternative embodiment, rather than having memory devices 34 mounted to the circuit board 32, other types of circuits, chips or components may be mounted to the circuit board 32.

The socket connector 16 is coupled to the circuit board 12. In the illustrated embodiment, the socket connector 16 constitutes a card edge connector that receives the circuit card 14 therein. The socket connector 16 may be configured to orient the circuit board 32 at a right angle with respect to the circuit board 12. Optionally, the circuit board 12 may have a generally horizontal orientation and the circuit board 32 may have a generally vertical orientation. Other orientations of the circuit board 32 and/or the circuit board 12 are possible in alternative embodiments, including where the circuit board 32 is oriented parallel to the circuit board 12. In an exemplary embodiment, the circuit board 12 relays both power and data, represented by the arrows 42, 44, respectively, to and/or from the socket connector 16.

Figure 2:
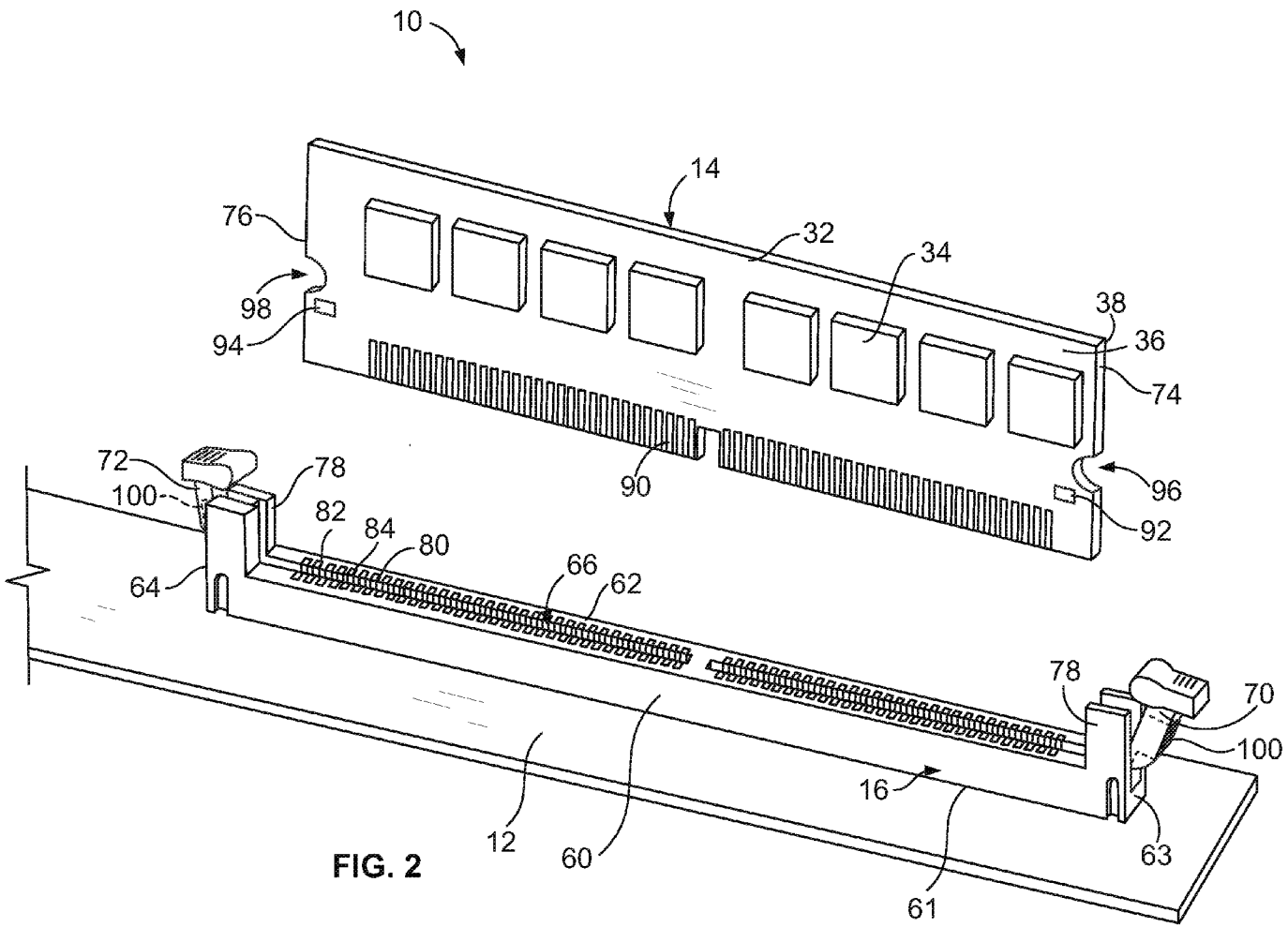
FIG. 2 is an exploded perspective view of the socket connector system shown in FIG. 1 showing a circuit card poised for loading into a socket connector.

FIG. 2 is an exploded perspective view of the socket connector system 10 showing the circuit card 14 poised for loading into the socket connector 16. The socket connector 16 includes a housing 60 having a base end 61 mounted to the circuit board 12. The housing 60 includes a mating end 62 generally opposite the base end 61 for mating with the circuit card 14. The housing 60 extends longitudinally between a first end 63 and a second end 64. The housing 60 includes a longitudinally extending slot 66 at the mating end 62 for receiving a card edge 68 of the circuit board 32. For example, the opening 66 may receive a bottom of the circuit board 32 and portions of the sides 36, 38 of the circuit board 32.

In an exemplary embodiment, the socket connector 16 includes first and second latches 70, 72 that hold the circuit card 14 within the socket connector 16. The latches 70, 72 extend away from the circuit board 12. The latches 70, 72 are configured to engage opposite first and second edges 74, 76 of the circuit board 32 to secure the circuit board 32 in the socket connector 16. The latches 70, 72 are pivotably coupled to the housing 60, such as to corresponding extensions 78 extending upward from the mating end 62. The latches 70, 72 are movable between a latched position (shown in FIG. 1) and an unlatched position (shown in FIG. 2). In the unlatched position, the circuit card 14 is freely movable into and out of the socket connector 16. In the latched position, the latches 70, 72 engage the circuit board 32 and secure the circuit card 14 in the socket connector 16.

In an exemplary embodiment, as described in further detail below, one or both of the latches 70, 72 include power conductors 100 (shown in phantom). The power conductors 100 supply power from the circuit board 12 to the circuit card 14. The power conductors 100 are movable with the latches 70, 72 to define a separable mating interface with the circuit board 12 and/or the circuit card 14.

A plurality of socket contacts 80 are held by the housing 60 within the slot 66 for mating with the circuit board 32. The socket contacts 80 may have a predetermined contact pattern for mating with a particular type of circuit card 14. Optionally, a subset of the socket contacts 80 may define power contacts 82 and another subset of the socket contacts 80 may define signal or data contacts 84. The socket contacts 80 may define other types of contacts as well, such as ground contacts. The power contacts 82 transmit power from the circuit board 12 to the circuit card 14. The data contacts 84 transmit data between the circuit board 12 and the circuit card 14.

Optionally, the power contacts 82 may be substantially identical in size, shape and/or positioning as the data contacts 84, such that the pinout pattern of the circuit board 12 determines which of the socket contacts 80 receives the power, thus defining power contacts 82, and which of the socket contacts 80 receives the data, thus defining data contacts 84. As such, the same socket connector 16 may have a different arrangement of power contacts 82 and data contacts 84 depending on the particular circuit board 12 to which the socket connector 16 is coupled. In an alternative embodiment, rather than the socket contacts 80 being substantially identically formed, the power contacts 82 may be structurally different than the data contacts 84. For example, the power contacts 82 may have a different size and shape and/or the power contacts 82 may be made from a different material or have a different coating.

The circuit card 14 includes a plurality of socket mating contacts 90 arranged at the card edge 68 of the circuit board 32. In the illustrated embodiment, the socket mating contacts 90 are contact pads and are arranged on both sides 36, 38 of the circuit board 32. The socket mating contacts 90 mate with corresponding socket contacts 80 of the socket connector 16. The socket mating contacts 90 have a similar pattern as the socket contacts 80 for mating thereto. The socket mating contacts 90 are electrically connected to the memory devices 34. Data and/or power are transmitted to and/or from the memory devices 34 through the socket mating contacts 90.

The circuit card 14 includes edge power contacts 92, 94 arranged at the first and second edges 74, 76 of the circuit board 32. The edge power contacts 92, 94 are located remote from the card edge 68 (e.g. the bottom) of the circuit board 32. For example, the edge power contacts 92, 94 may be located approximately centered between the bottom and the top of the circuit board 32. In the illustrated embodiment, the edge power contacts 92, 94 are contact pads. The edge power contacts 92, 94 may be arranged on both sides 36, 38 of the circuit board 32. The edge power contacts 92, 94 are configured to be electrically connected to the power conductors 100 of the latches 70, 72 when the latches 70, 72 are in the latched position. The edge power contacts 92, 94 are electrically connected to the memory devices 34 and supply power to the memory devices 34, such as by traces routed between the edge power contacts 92, 94 and the corresponding memory devices 34. Optionally, a voltage regulator may be provided on the circuit card 14, and the power may be routed through the voltage regulator from the edge power contacts 92, 94 and the socket mating contacts 90 prior to being routed to the memory devices 34.

During assembly, the circuit card 14 is coupled to the socket connector 16 by plugging the card edge 68 of the circuit board 32 into the slot 66. The socket mating contacts 90 engage the socket contacts 80 to create an electrical connection therebetween. Power and data can be transmitted between the socket connector 16 and the circuit card 14 when the circuit card 14 is connected to the socket connector 16. Once the circuit card 14 is loaded into the socket connector 16, the latches 70, 72 are pivoted to the latched position, securing the circuit card 14 in the socket connector 16. In the latched position, the power conductors 100 are electrically connected to, and supply power to, the edge power contacts 92, 94. In an exemplary embodiment, the latches 70, 72 are received in notches 96, 98 in the first and second edges 74, 76 to hold the circuit card 14 in the socket connector 16.

In operation, power and data is transmitted to the circuit card 14 by the socket connector 16. Data is transmitted between the data contacts 84 and the corresponding socket mating contacts 90. Power is transmitted between the power contacts 82 and the corresponding socket mating contacts 90. Power is also transmitted to the circuit card 14 by the power conductors 100 of the latches 70, 72.

Figure 3:
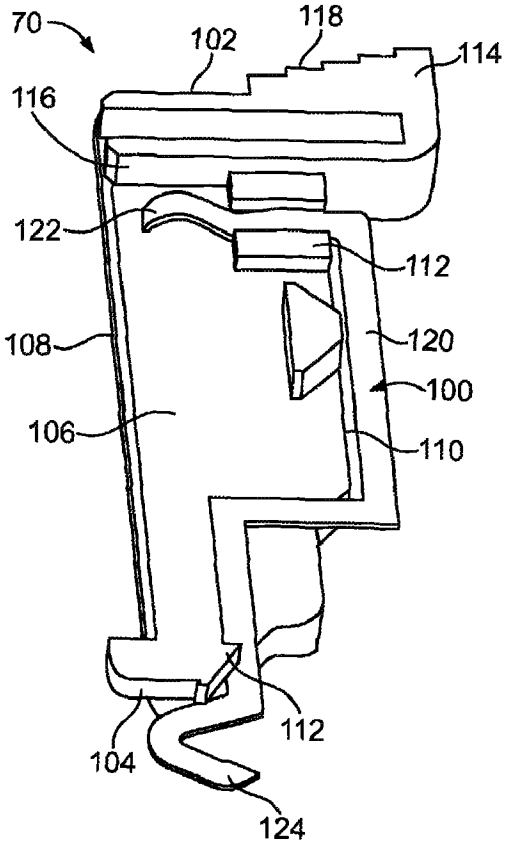
FIG. 3 is a side view of a latch of the socket connector shown in FIGS. 1 and 2 with a power conductor.

FIG. 3 is a side view of the latch 70 and an exemplary embodiment of the power conductor 100 of the latch 70. The power conductor 100 is held by the latch 70 and is movable with the latch 70. Optionally, the power conductor 100 may be held on an exterior of the latch 70. Alternatively, the power conductor 100 may be partially, or entirely, held internal of the latch 70. In other alternative embodiments, the body of the latch 70 may define the power conductor, whereby a separate power contact need not be provided. In such embodiment, portions of the latch 70 may be coated or covered by a dielectric material.

The latch 70 includes a top 102 and a bottom 104. The latch 70 includes a side 106 extending between the top 102 and the bottom 104. The latch 70 includes an interior edge 108 and an exterior edge 110 extending between the top 102 and the bottom 104. The interior edge 108 is configured to face the circuit card 14 (shown in FIGS. 1 and 2). The exterior edge 110 faces away from the circuit card 14. In the illustrated embodiment, the power conductor 100 is held along the side 106 and extends generally along a portion of the exterior edge 110. Optionally, a second power conductor (not shown) may be provided on the opposite side of the latch 70.

The latch 70 includes mounting features 112 for securing the power conductor 100 to the latch 70. In the illustrated embodiment, the mounting features 112 are open sided channels that receive the power conductor 100. Other types of mounting features may be used in alternative embodiments to secure the power conductor 100 to the latch 70. In some embodiments, the channels may be closed such that at least a portion of the power conductor 100 is encased or entirely surrounded by the latch 70 and/or the mounting feature 112.

The latch 70 includes a head 114 at the top 102. The head 114 extends outward from the side 106. The head 114 includes a nose 116 which is configured to be received in the notch 96 to secure the circuit card 14 within the socket connector 16. The head 114 includes a finger grip 118 on the top surface thereof, which enables an operator to actuate the latch 70.

The power conductor 100 includes a contact body 120 extending between a first end 122 and a second end 124. The first end 122 is configured to engage, and be electrically connected to, the circuit card 14. The second end 124 is configured to engage, and be electrically connected to, the circuit board 12 (shown in FIGS. 1 and 2). The contact body 120 is manufactured from a conductive material, such as a metal. The contact body 120 defines a conductive pathway between the first end 122 and the second end 124. As such, the contact body 120 defines a conductive pathway between the circuit board 12 and the circuit card 14. In an exemplary embodiment, the contact body 120 is a single piece, with the first and second ends 122, 124 being integrally formed with the contact body 120. For example, the power conductor 100 may be stamped and formed. Optionally, portions of the contact body 120 may be coated or plated, such as at the first and second ends 122, 124 where the power conductor 100 makes electrical contact with the circuit card 14 and the circuit board 12.

Figure 4:
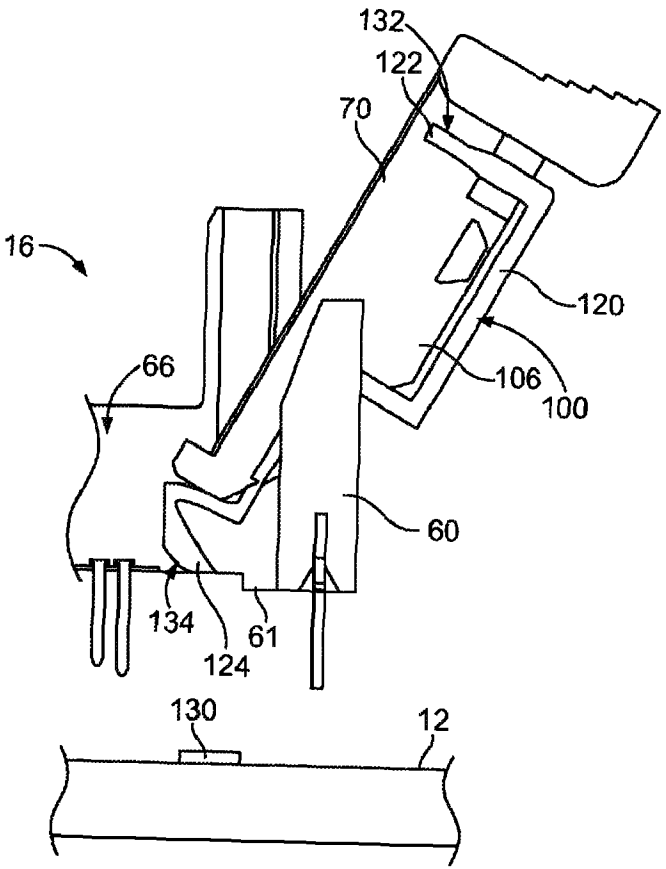
FIG. 4 is a side view of a portion of the socket connector system showing the socket connector poised for mounting to a circuit board.
Figure 5:
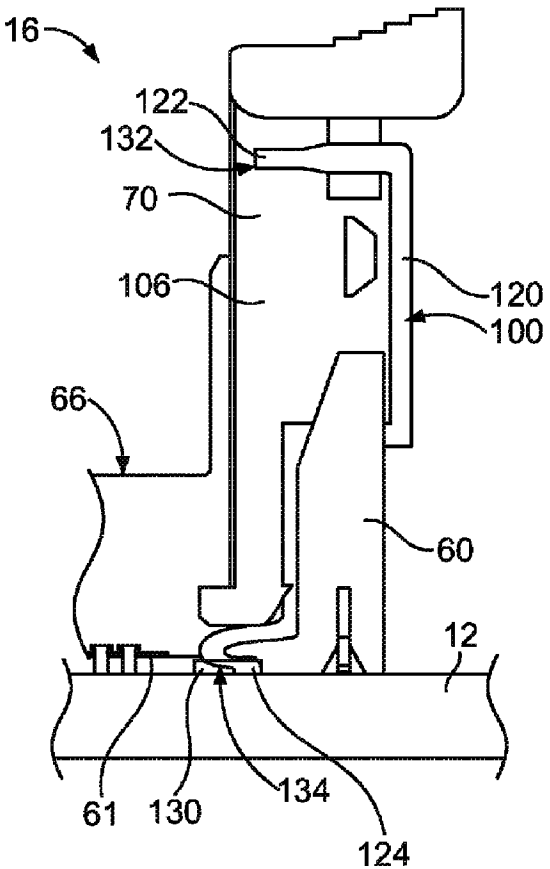
FIG. 5 is a side sectional view of a portion of the socket connector system showing the socket connector mounted to a circuit board.

FIG. 4 is a side view of a portion of the socket connector system 10 showing the socket connector 16 poised for mounting to the circuit board 12. FIG. 5 is a side view of a portion of the socket connector system 10 showing the socket connector 16 mounted to the circuit board 12. The latch 70 is pivotably coupled to the housing 60. The latch 70 is movable between an unlatched position (shown in FIG. 4) and a latched position (shown in FIG. 5). The power conductor 100 is held by the latch 70 and is movable with the latch 70.

The circuit board 12 includes a power contact 130 for mating with the power conductor 100. In the illustrated embodiment, the power contact 130 is a contact pad on a surface of the circuit board 12. The power conductor 100 is configured to make a physical connection with the power contact 130. In an exemplary embodiment, the power conductor 100 is configured to be physically separable from the power contact 130 for repeated mating and unmating with the power contact 130. In alternative embodiment, the power conductor 100 may be soldered to the power contact 130 such that the second end 124 is fixed with respect to the power contact 130, while the first end 122 is movable with the latch 70. In another alternative embodiment, the power contact 130 may be a plated via through the circuit board 12 and the power conductor 100 may be through-holed mounted to the power contact 130.

The power conductor 100 has a first mating interface 132 at the first end 122 and a second mating interface 134 at the second end 124. The first mating interface 132 defines a separable interface that is matable to, and unmatable from, the edge power contact 92 (shown in FIG. 2) of the circuit card 14 (shown in FIG. 2). For example, the power conductor 100 is moved with the latch 70 as the latch 70 is moved from the unlatched position (shown in FIG. 4) to the latched position (shown in FIG. 5). When the latch 70 is in the latched position, the first mating interface 132 is aligned with and engages the edge power contact 92. In an exemplary embodiment, the power conductor 100 is curved at the first end 122 out of the plane of the power conductor 100, such as away from the side 106 of the latch 70, to define a spring beam at the first end 122. The first end 122 is configured to be deflected when mated with the edge power contact 92, such that the first end 122 is spring biased against the edge power contact 92.

In the illustrated embodiment, the second mating interface 134 defines a separable mating interface that is configured to be matable to, and unmatable from, the power contact 130. The second end 124 is curved to define a spring beam at the second end 124. The second end 124 is deflectable when the power conductor 100 is mated to the circuit board 12 such that the spring beam is compressed and is spring biased against the power contact 130. In an alternative embodiment, rather than defining a separable mating interface, the second end 124 may be soldered to the power contact 130. In such embodiment, pivoting of the latch 70 from the latched position to the unlatched position causes the contact body 120 to flex, while the second end 124 remains fixed to the power contact 130.

During assembly, the latch 70 is moved to the unlatched position. The housing 60 is mounted to the circuit board 12. When the latch 70 is in the unlatched position, the second end 124 is elevated above the base end 61 such that the second end 124 does not interfere with the mounting of the housing 60 to the circuit board 12. Once positioned, the latch 70 may then be moved to the latched position. As the latch 70 is moved to the latched position, the second end 124 begins to engage the power contact 130. The spring beam at the second end 124 is deflected as the latch 70 is moved to the latched position. Optionally, when the second end 124 is positioned in engagement with the power contact 130, the second end 124 may be soldered to the power contact 130.

During use, the latch 70 is rotated from the latched position to the unlatched position so that the circuit card 14 may be plugged into the socket connector 16. Once the latch 70 is clear of the slot 66, the circuit card 14 may be loaded into the slot 66 and then the latch 70 may be moved to the latched position. As the latch 70 is moving to the latched position, the first end 122 of the power conductor 100 begins to engage the edge power contact 92. Such engagement causes the first end 122 to deflect imparting a normal force against the edge power contact 92.

Figure 6:
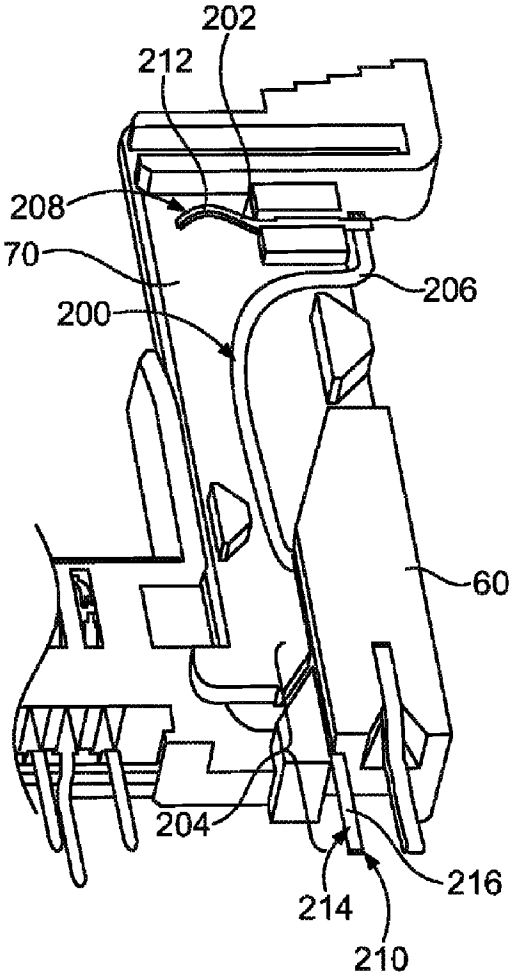
FIG. 6 illustrates a portion of the socket connector system showing a latch of the socket connector with a power conductor.

FIG. 6 illustrates a portion of the socket connector system 10 using a power conductor 200 with the latch 70. FIG. 6 illustrates the latch 70 attached to the housing 60.

The power conductor 200 includes a first mating contact 202 and a second mating contact 204. The power conductor 200 includes a wire 206 extending between, and electrically connecting, the first and second mating contacts 202, 204. The first mating contact 202 is provided at a first end 208 of the power conductor 200. The second mating contact 204 is provided at a second end 210 of the power conductor 200. The first mating contact 202 includes a first mating interface 212 that is configured to be removably coupled to the circuit card 14 (shown in FIGS. 1 and 2). The second mating contact 204 includes a second mating interface 214 that is configured to be terminated to the circuit board 12 (shown in FIGS. 1 and 2). In the illustrated embodiment, the first mating contact 202 includes a spring beam defining the first mating interface 212. The spring beam is deflectable and is configured to be spring biased against the edge power contact 92 (shown in FIG. 2) when mated thereto. The first mating contact 202 is terminated to the wire 206, such as by a crimp connection, an insulation displacement connection, a solder connection, and the like.

The second mating contact 204 includes a tail 216. Optionally, the tail 216 may be soldered to a power contact on the circuit board 12. Alternatively, the tail 216 may be through-hole mounted to a power contact of the circuit board 12. For example, the tail 216 may include a compliant section that may engage a plated via of the circuit board 12. The second mating contact 204 is terminated to the wire 206, such as by a crimp connection, an insulation displacement connection, a solder connection, and the like.

The wire 206 is routed between the first mating contact 202 and the second mating contact 204. The wire 206 is flexible and may be bent when the latch 70 is moved between the latched position and the unlatched position. Such flexibility of the wire 206 relieves stress or strain on the first mating contact 202 and the second mating contact 204 when the latch 70 is moved between the latched position and the unlatched position. The second mating interface 214, which may be soldered to the power contact of the circuit board 12, is less likely to be fatigued or damaged by the movement of the latch 70 between the latched position and the unlatched position because of the flexibility of the wire 206.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A socket connector comprising:

a dielectric housing extending longitudinally between a first end and a second end, the dielectric housing having a slot extending longitudinally, the slot being configured to receive a circuit card therein;

contacts held by the dielectric housing and exposed at the slot, the contacts being configured to be electrically connected to the circuit card, the contacts being configured to be terminated to a circuit board; and a latch at the first end configured to secure the circuit card in the dielectric housing, the latch including a power conductor, the power conductor being configured to be electrically connected to the circuit card, the power conductor being configured to be terminated to the circuit board to supply power between the circuit board and the circuit card.

2. The socket connector of claim 1, wherein the latch is pivotably coupled to the dielectric housing, the power conductor being pivoted with the latch.

3. The socket connector of claim 1, wherein the power conductor includes a first mating interface and a second mating interface, the second mating interface being configured to be terminated to the circuit board, the first mating interface defining a separable interface that is matable to, and unmatable from, the circuit card as the latch is moved between a latched position and an unlatched position.

4. The socket connector of claim 1, wherein the power conductor includes a first mating interface and a second mating interface, the first mating interface defining a separable interface that is matable to, and unmatable from, the circuit card as the latch is moved between a latched position and an unlatched position, the second mating interface defining a separable interface that is matable to, and unmatable from, the circuit board as the latch is moved between the latched position and the unlatched position.

5. The socket connector of claim 1, wherein the power conductor includes a contact body extending between a first end and a second end, the first end defining a separable mating interface configured to be removably coupled to the circuit card, the second end being solderable to the circuit board, the contact body flexing as the latch is rotated between a latched position and an unlatched position.

6. The socket connector of claim 1, wherein the latch is rotatable between a latched position and an unlatched position, the power conductor including a contact body extending between a first end and a second end, the first end defining a separable mating interface configured to be removably coupled to the circuit card, the second end defining a separable mating interface configured to be removably coupled to the circuit board, the second end being deflected and spring biased against the circuit board when the latch is moved from the unlatched position to the latched position.

7. The socket connector of claim 1, wherein the power conductor includes a first mating contact and a second mating contact, the power conductor includes a wire extending between, and electrically connecting, the first and second mating contacts, the first mating contact being removably coupled to the circuit card as the latch is rotated between the latched position and an unlatched position, the second mating contact being configured to be terminated to the circuit board.

8. The socket connector of claim 1, further comprising a second latch at the second end configured to secure the circuit card in the dielectric housing, the second latch holding a second power conductor, the latch and the second latch being pivotably coupled to the dielectric housing, the power conductor being pivoted with the latch, the second power conductor being pivoted with the second latch.

9. The socket connector of claim 1, further comprising a second power conductor held by the latch on an opposite side of the latch, the second power conductor being configured to engage an opposite side of the circuit card as the other power conductor.

10. A socket connector comprising:

a dielectric housing extending longitudinally between a first end and a second end, the dielectric housing having a slot extending longitudinally, the slot being configured to receive a circuit card therein;

contacts held by the dielectric housing and exposed at the slot, the contacts being configured to be electrically connected to the circuit card, the contacts being configured to be terminated to a circuit board; and a latch at the first end, the latch being movable between a latched position and an unlatched position, the latch being configured to engage the circuit card in the latched position, the latch including a power conductor that extends between a first mating interface and a second mating interface, the power conductor being movable with the latch, the first mating interface being mated to the circuit card when the latch is in the latched position, the first mating interface being unmated from the circuit card when the latch is in the unlatched position, the second mating interface being configured to be terminated to the circuit board to supply power between the circuit board and the circuit card.

11. The socket connector of claim 10, wherein the latch is pivotably coupled to the dielectric housing, the power conductor being pivoted with the latch.

12. The socket connector of claim 10, wherein the second mating interface defines a separable interface that is matable to, and unmatable from, the circuit board as the latch is moved between the latched position and the unlatched position.

13. The socket connector of claim 10, wherein the power conductor includes a contact body extending between a first end and a second end, the first end defining the first mating interface, the second end being solderable to the circuit board, the contact body flexing as the latch is rotated between a latched position and an unlatched position.

14. The socket connector of claim 10, wherein the power conductor includes a contact body extending between a first end and a second end, the first end defining the first mating interface, the second end defining the second mating interface, the second mating interface being a separable mating interface configured to be removably coupled to the circuit board, the second end being deflected and spring biased against the circuit board when the latch is moved from the unlatched position to the latched position.

15. The socket connector of claim 10, wherein the power conductor includes a first mating contact and a second mating contact, the power conductor includes a wire extending between, and electrically connecting, the first and second mating contacts, the first mating contact being removably coupled to the circuit card as the latch is rotated between the latched position and an unlatched position, the second mating contact being configured to be terminated to the circuit board.

16. A socket connector system comprising:

a circuit card having a circuit board extending between a first edge and a second edge, the circuit board having a card edge extending between the first and second edges of the circuit board, the circuit board having card contacts at the card edge, the memory card circuit board having an edge power contact at the first edge, the circuit card having at least one memory component terminated to the circuit board and being electrically connected to the edge power contact and at least one of the card contacts; and a socket connector including:

a dielectric housing extending longitudinally between a first end and a second end, the dielectric housing having a slot extending longitudinally, the slot receiving the card edge of the circuit board therein;

contacts held by the dielectric housing and exposed at the slot, the contacts being electrically connected to corresponding card contacts, the contacts being configured to be terminated to a circuit board; and a latch at the first end, the latch engaging the first edge to secure the circuit card in the dielectric housing, the latch including a power conductor, the power conductor being configured to be electrically connected to the edge power contact, the power conductor being configured to be terminated to the circuit board to supply power between the circuit board and the circuit card.

17. The socket connector of claim 16, wherein the latch is pivotably coupled to the dielectric housing, the power conductor being pivoted with the latch.

18. The socket connector of claim 16, wherein the power conductor includes a first mating interface and a second mating interface, the first mating interface defining a separable interface that is matable to, and unmatable from, the circuit card as the latch is moved between a latched position and an unlatched position, the second mating interface defining a separable interface that is matable to, and unmatable from, the circuit board as the latch is moved between the latched position and the unlatched position.

19. The socket connector of claim 16, wherein the power conductor includes a contact body extending between a first end and a second end, the first end defining a separable mating interface configured to be removably coupled to the circuit card, the second end being solderable to the circuit board, the contact body flexing as the latch is rotated between a latched position and an unlatched position.

20. The socket connector of claim 16, further comprising a second latch at the second end to secure the circuit card in the dielectric housing, the second latch holding a second power conductor, the latch and the second latch being pivotably coupled to the dielectric housing, the power conductor being pivoted with the latch, the second power conductor being pivoted with the second latch.

* * * * *